US010374356B2

(12) United States Patent
Amerio et al.

(10) Patent No.: US 10,374,356 B2
(45) Date of Patent: Aug. 6, 2019

(54) ELECTRICAL CONNECTOR HAVING TELESCOPIC STRUCTURE

(71) Applicant: Tyco Electronics AMP Italia S.R.L., Turin (IT)

(72) Inventors: Fulvio Amerio, Turin (IT); Alessandro Genta, Alpignano (IT)

(73) Assignee: Tyco Electronics AMP Italia S.R.L., Turin (IT)

( * ) Notice: Subject to any disclaimer, the term of this patent is extended or adjusted under 35 U.S.C. 154(b) by 0 days.

(21) Appl. No.: 15/988,614

(22) Filed: May 24, 2018

(65) Prior Publication Data

US 2018/0342834 A1 Nov. 29, 2018

(30) Foreign Application Priority Data

May 25, 2017 (IT) ..... 102017000057059

(51) Int. Cl.
*H01R 13/629* (2006.01)
*H01R 13/639* (2006.01)

(52) U.S. Cl.
CPC . *H01R 13/62961* (2013.01); *H01R 13/62944* (2013.01); *H01R 13/62955* (2013.01); *H01R 13/62977* (2013.01); *H01R 13/639* (2013.01)

(58) Field of Classification Search
CPC ..... H01R 13/62961; H01R 13/46; H01R 13/62944; H01R 13/62955
See application file for complete search history.

(56) References Cited

U.S. PATENT DOCUMENTS

| | | | | |
|---|---|---|---|---|
| 7,361,036 | B2 | 4/2008 | Pittenger et al. | |
| 9,048,579 | B2 * | 6/2015 | Itou | H01R 13/62944 |
| 9,088,100 | B2 * | 7/2015 | Volantin | H01R 13/62938 |
| 9,425,554 | B2 * | 8/2016 | Iwatani | H01R 13/6275 |

FOREIGN PATENT DOCUMENTS

| | | | |
|---|---|---|---|
| DE | 102006045155 | A1 | 4/2008 |
| WO | 2007044393 | A2 | 4/2007 |
| WO | 2009129062 | A1 | 10/2009 |
| WO | 2012007343 | A1 | 1/2012 |

OTHER PUBLICATIONS

Italian Search Report, dated Dec. 7, 2017, 8 pages.

* cited by examiner

*Primary Examiner* — Briggitte R. Hammond
(74) *Attorney, Agent, or Firm* — Barley Snyder

(57) ABSTRACT

An electrical connector comprises a contact-carrying body having a plurality of electrical terminals, a slide member slidably mounted within the contact-carrying body and having a rack, an upper body mounted to the contact-carrying body, and a lever pivotally mounted on the upper body. The lever has a toothed wheel engaging the rack; movement of the lever between an inoperative position and an operative position moves the slide member between a retracted position and an advanced position. The lever has arms and a handle. Each arm of the lever has a telescoping structure including a first arm portion and a second arm portion slidably mounted to the first arm portion and connected to the handle. A movable portion including the second arm portion of each arm and the handle is movable with respect to each of the first arm portions between an elongated lever position and a shortened lever position.

15 Claims, 11 Drawing Sheets

ELECTRICAL CONNECTOR HAVING TELESCOPIC STRUCTURE

CROSS-REFERENCE TO RELATED APPLICATION

This application claims the benefit of the filing date under 35 U.S.C. § 119(a)-(d) of Italian Patent Application No. 102017000057059, filed on May 25, 2017.

FIELD OF THE INVENTION

The present invention relates to an electrical connector and, more particularly, to an electrical connector having an actuation lever.

BACKGROUND

A known electrical connector has a support structure made of a plastic material. The support structure includes a contact-carrying body carrying a plurality of electrical terminals, a slide member slidably mounted within the contact-carrying body, an upper body mounted above the contact-carrying body, and an actuation lever pivotally mounted on said upper body and having at least one toothed wheel or toothed wheel sector engaging with a rack of the slide member. The lever is movable between an inoperative position and an operative position and correspondingly moves the slide member between a retracted position and an advanced position.

An electrical connector C of this known type is shown in FIGS. 1-3. The electrical connector C is matable with a mating connector O. FIGS. 2 and 3 show two adjacent mating connectors O, with the connector C coupled to one of the mating connectors O. FIG. 2 shows a preliminary coupling state, while FIG. 3 shows a final coupling state reached by moving an actuation lever 4 of the connector C from its inoperative position shown in FIG. 2 to its operative position shown in FIG. 3.

The connector C has a support structure made of plastic material carrying a plurality of electrical terminals T1 for mechanical and electrical coupling to terminals T2 of the mating connector O. The connector C includes a contact-carrying body 1 of quadrilateral shape having two opposing side walls and two opposing end walls. The contact-carrying body 1 carries the electrical terminals T1 to which a plurality of conductors F are electrically connected.

Above the contact-carrying body 1, an upper body 3 shown in FIGS. 1-3, also made of a plastic material, is rigidly connected to the contact-carrying body 1. The rigid connection of the upper body 3 to the contact-carrying body 1 is achieved by the mutual engagement of elastic teeth and corresponding seats formed in the bodies 1, 3.

The connector C further comprises a slide member 2, also made of plastic material, slidably mounted within the contact-carrying body 1 and actuable using the actuation lever 4 pivotally mounted on the upper body 3. The lever 4 has two arms 40 and a handle 41 that connects the two arms 40. As shown in FIGS. 2 and 3, the lever 4 has a pair of toothed wheels 42 each integrated into the terminal end of the arm 40 opposite the end of the arm 40 connected to the handle 41. Each toothed wheel 42 is rotatable, together with the entire lever 4, about the pivot axis of the lever 4 on the upper body 3. As shown in FIGS. 2 and 3, each toothed wheel 42 engages in a rack 5 of a side wall of the slide member 2. Actuation of the lever 4 from its inoperative position to its operative position causes a movement of the slide member 2 with respect to the contact-carrying body 1 from a retracted position to an advanced position within the contact-carrying body 1.

As shown in FIG. 2, when the connector C is in the preliminary coupling state with the mating connector O, a plurality of pins O1 provided on the side walls O2 of the mating connector O are housed in respective slits 20 provided along the side walls of the slide member 2. During actuation of the lever 4 from its inoperative position shown in FIG. 2 to its operative position shown in FIG. 3, the slide member 2 performs a combined translation and lowering movement with respect to the mating connector O guided by the shape of the slits 20. This combined movement is a horizontal translation of the slide member 2 with respect to the contact-carrying body 1 and a vertical lowering of the contact-carrying body 1 on the mating connector O.

The rotation of the lever 4 into its operative position brings about the complete coupling of the terminals T1, T2 carried by the contact-carrying body 1 and by the mating connector O. The combined movement of the slide member 2 is guided by the shape of the slits 20 in which the pins O1 engage and is controlled by the lever 4, as the rack 5 provided on each side wall of the slide member 2 engages with the toothed wheel 42 carried by the respective arm 40 of the lever 4.

Similar electrical connectors having an actuation lever are also shown and described in U.S. Pat. No. 7,361,036 B2, WO 2009/129062 A1, and WO 2012/007343 A1. WO 2012/007343, for example, discloses an actuation lever provided with a slidable element that serves as a CPA (connection position assurance) device, ensuring correct coupling of the connector with the mating connector. In the electrical connectors described above, however, a significant force must be applied to the actuation lever to couple the connector to the mating connector.

SUMMARY

An electrical connector comprises a contact-carrying body having a plurality of electrical terminals, a slide member slidably mounted within the contact-carrying body and having a rack, an upper body mounted to the contact-carrying body, and a lever pivotally mounted on the upper body. The lever has a toothed wheel engaging the rack; movement of the lever between an inoperative position and an operative position moves the slide member between a retracted position and an advanced position. The lever has arms and a handle. Each arm of the lever has a telescoping structure including a first arm portion and a second arm portion slidably mounted to the first arm portion and connected to the handle. A movable portion including the second arm portion of each arm and the handle is movable with respect to each of the first arm portions between an elongated lever position and a shortened lever position.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
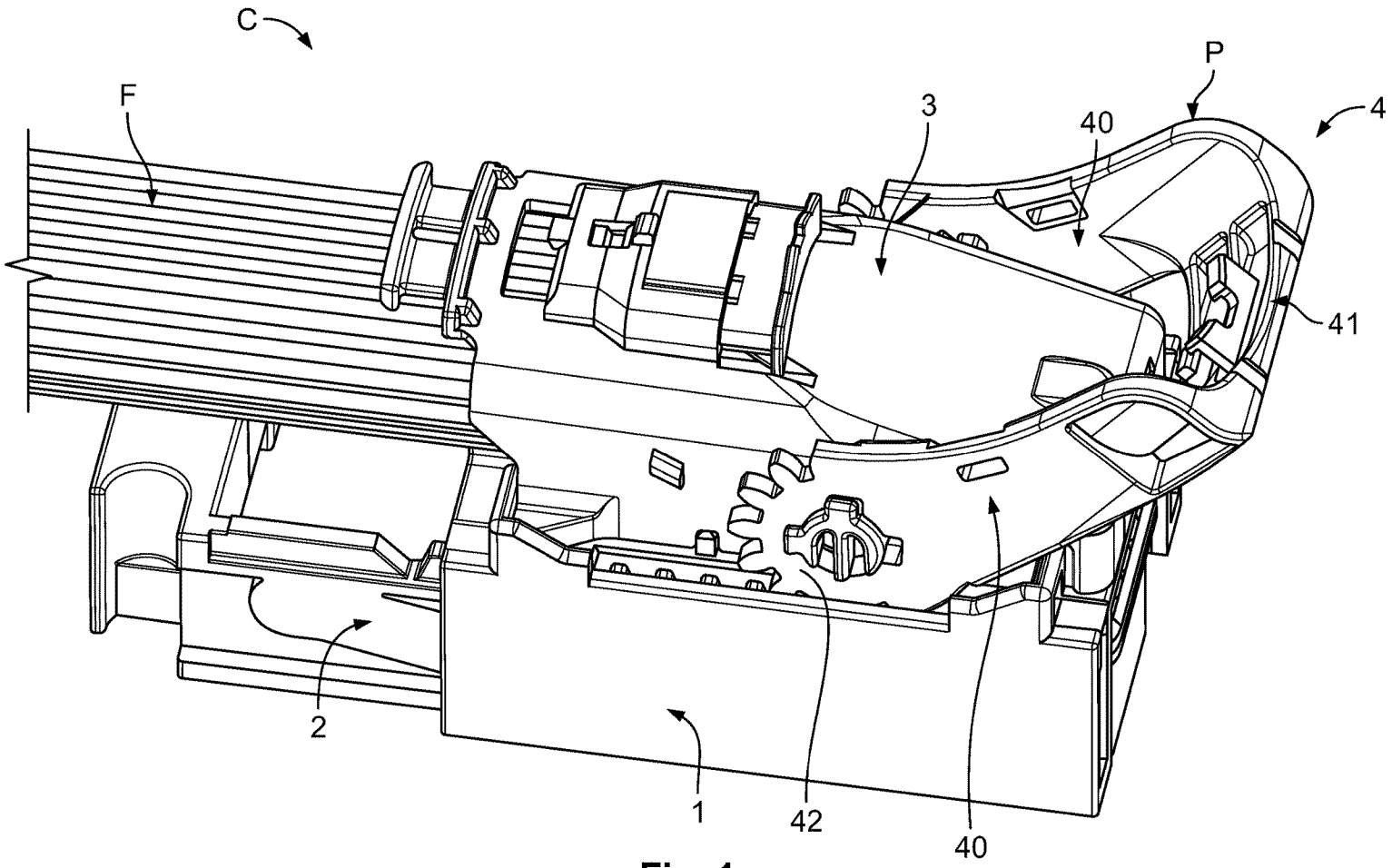
Fig. 1 PRIOR ART
FIG. 1 is a perspective view of an electrical connector known in the art.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

Figure 2:
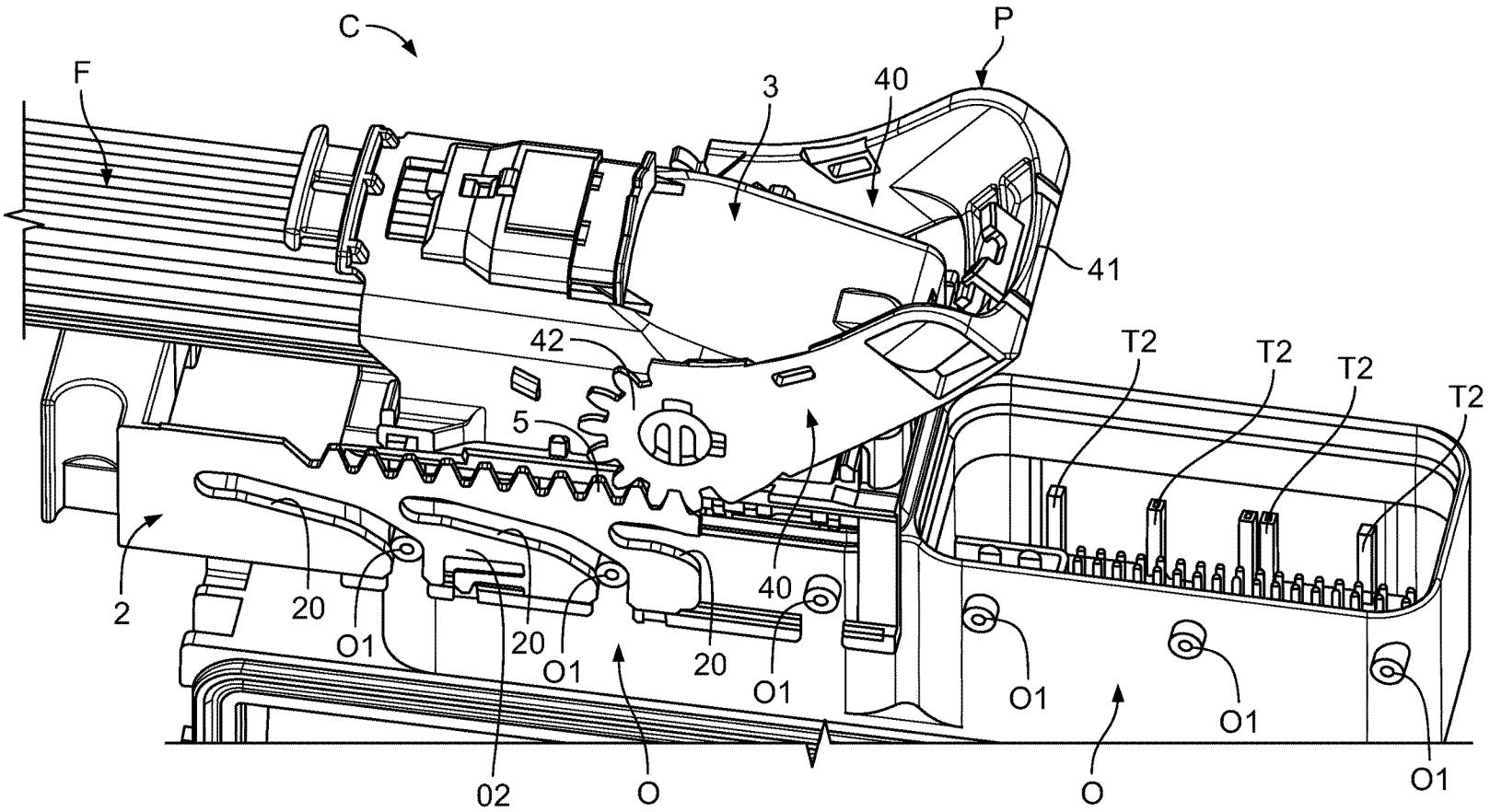
Fig. 2 PRIOR ART
FIG. 2 is a perspective view of the electrical connector of FIG. 1 in an inoperative position with a mating connector.
Figure 3:
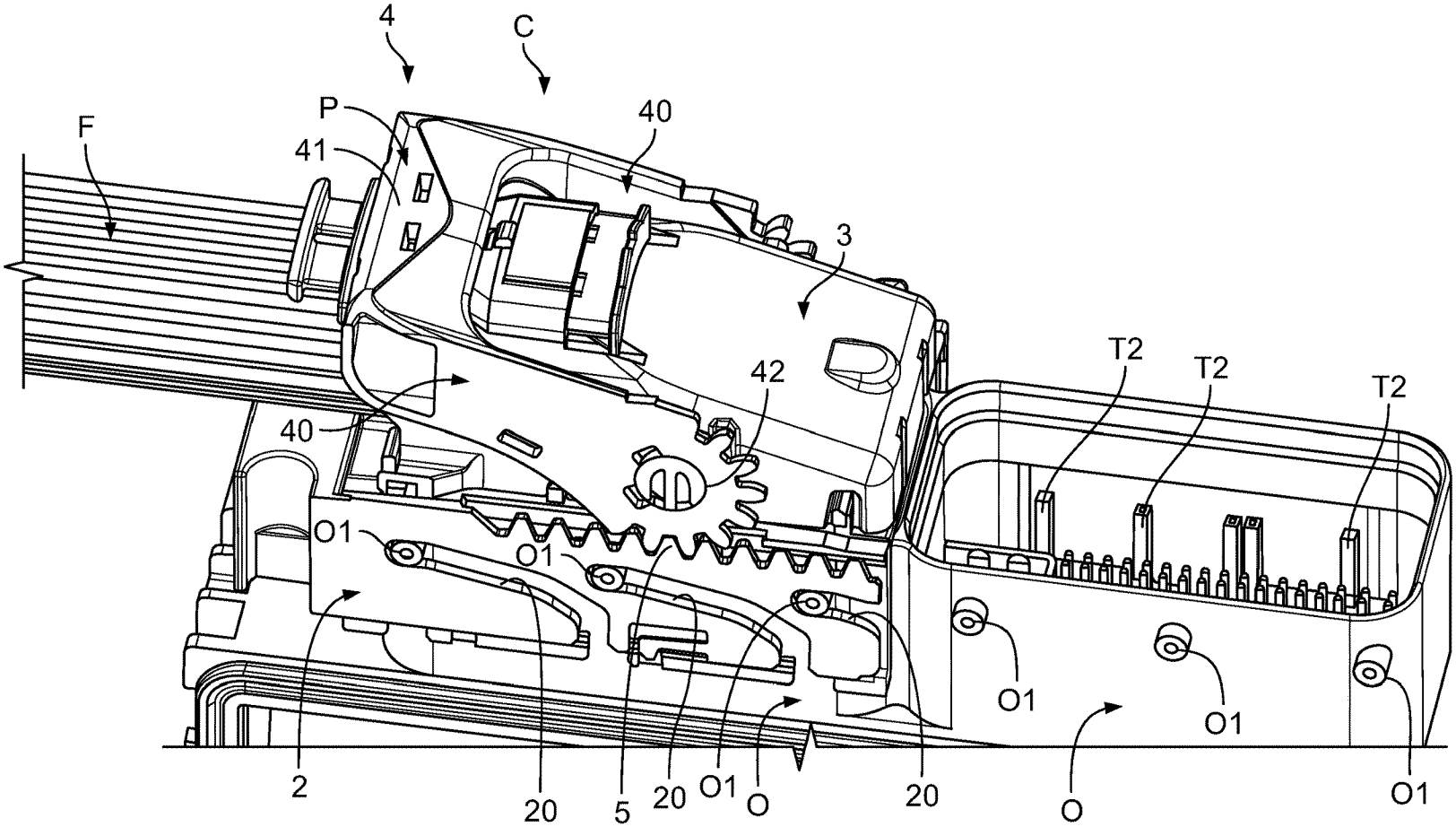
Fig. 3 PRIOR ART
FIG. 3 is a perspective view of the electrical connector of FIG. 1 in an operative position with the mating connector.

An electrical connector E according to an embodiment of the invention is shown in FIG. 4-11. All parts of the connector E according to the invention which are common with the connector C of FIGS. 1-3 are given the same reference numerals herein, since these parts have the same structure and functionality as described above.

Figure 4:
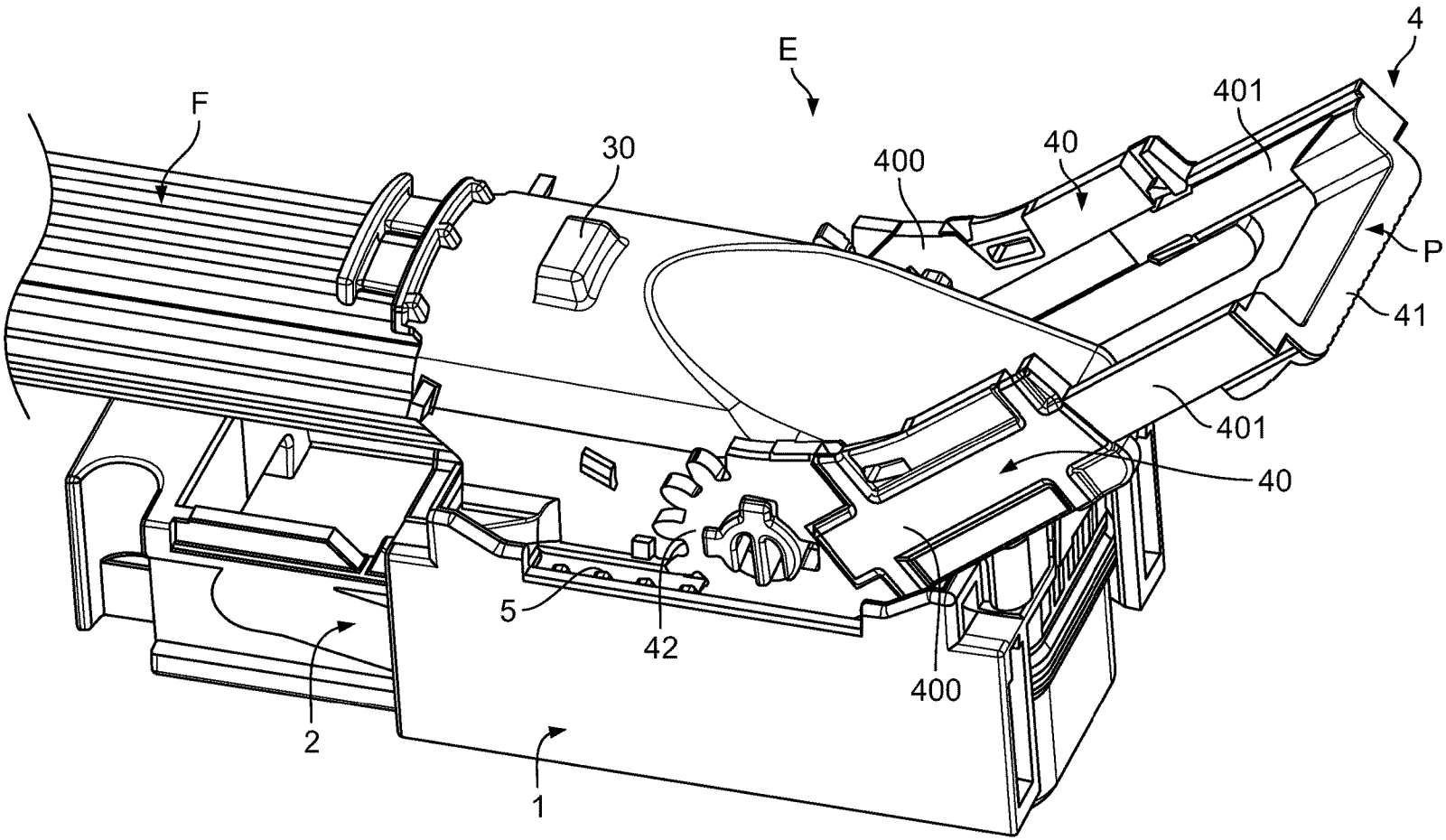
FIG. 4 is a perspective view of an electrical connector according to an embodiment of the invention.
Figure 5:
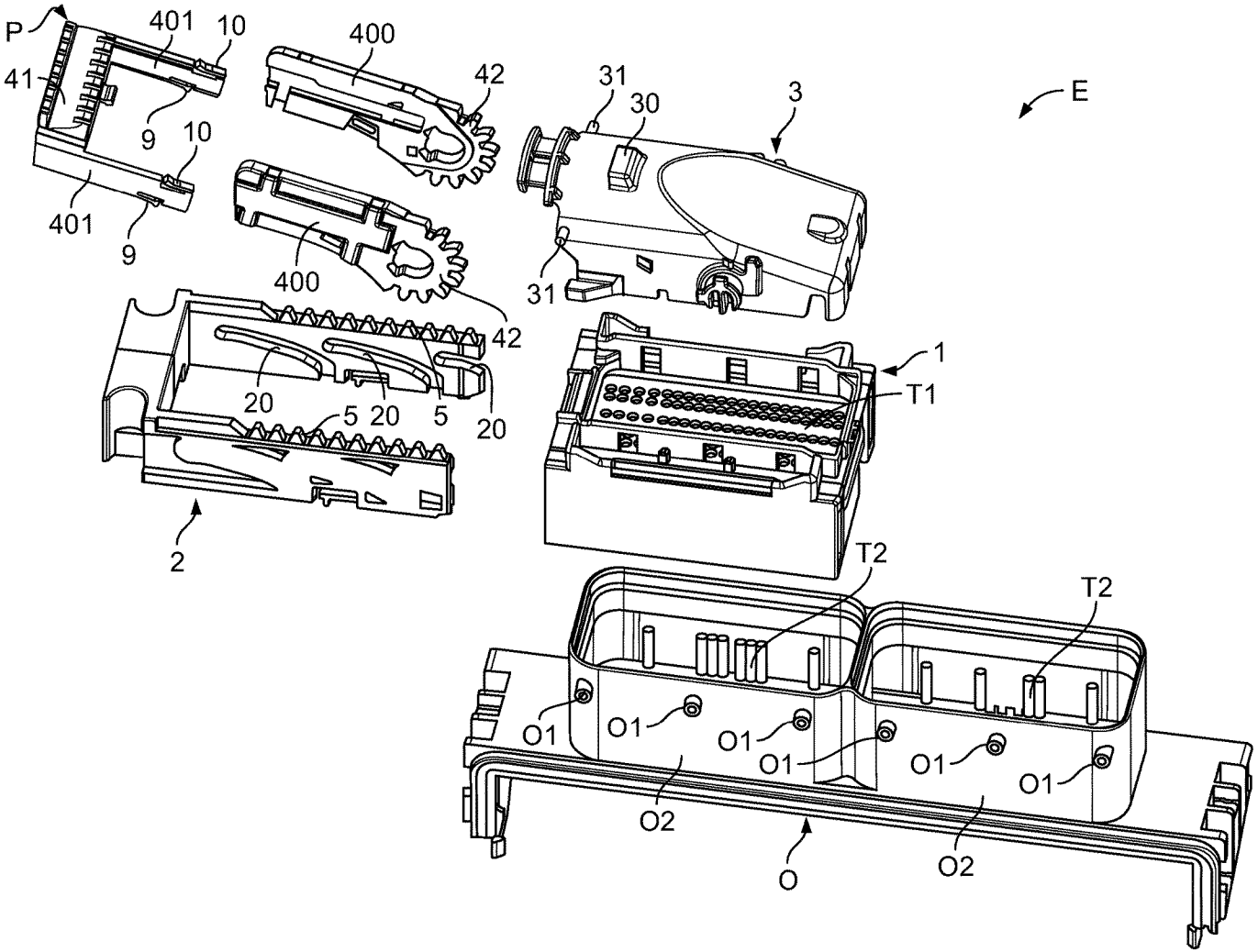
FIG. 5 is an exploded perspective view of the electrical connector of FIG. 4 and a mating connector.

In the connector E, shown in FIGS. 4 and 5, each arm 40 of the lever 4 has a telescopic structure capable of varying a total length of the lever 4. The telescopic structure includes a first arm portion 400 and a second arm portion 401. The second arm portion 401 is slidably mounted with respect to the first arm portion 400 and is connected to the handle 41 of the lever 4. The actuation lever 4 thus comprises a portion P which is movable with respect to each of the first arm portions 400 and which includes the second portion 401 of each arm 40 and the handle 41.

Figure 6:
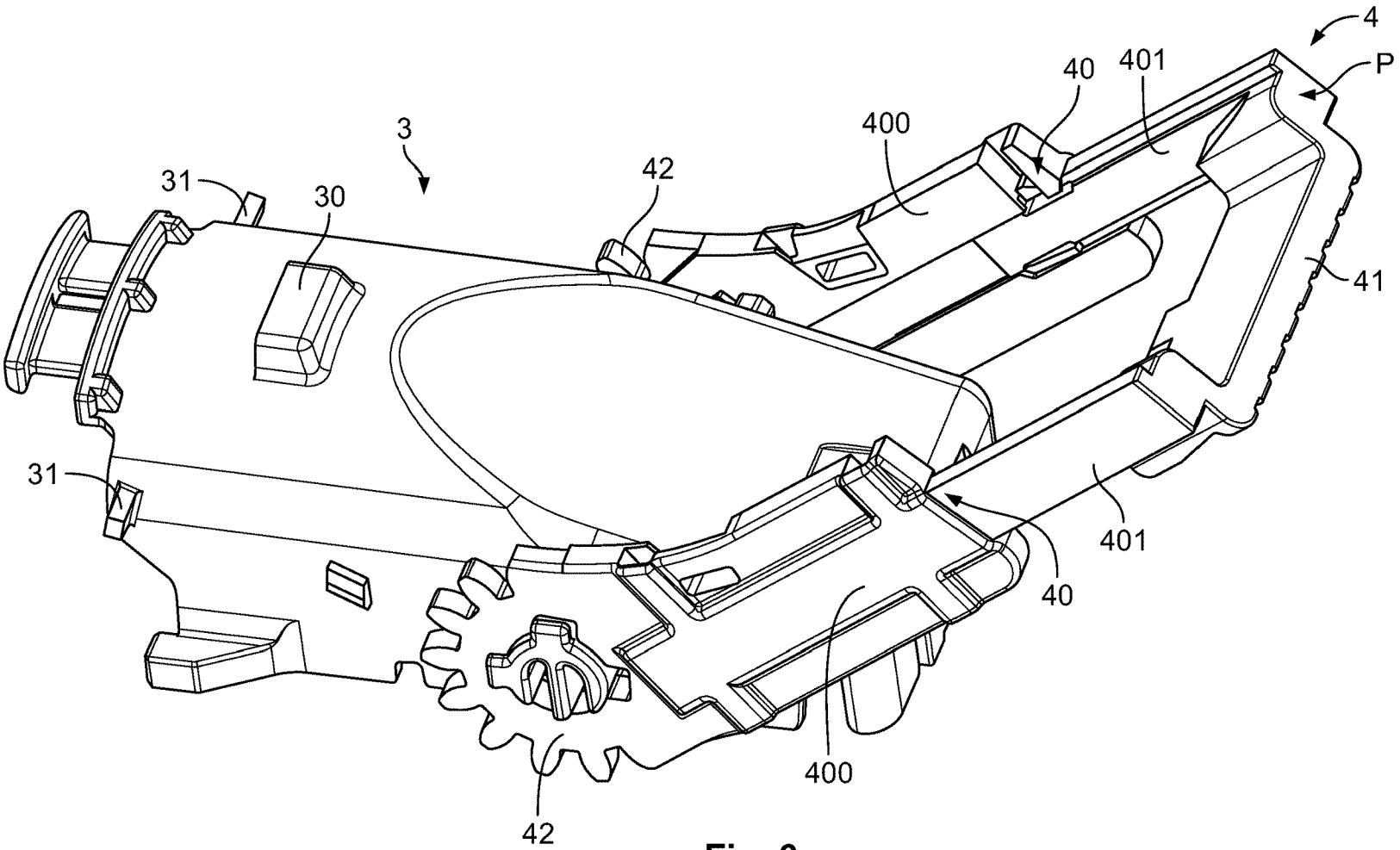
FIG. 6 is a perspective view of the electrical connector of FIG. 4 in an inoperative position.
Figure 7:
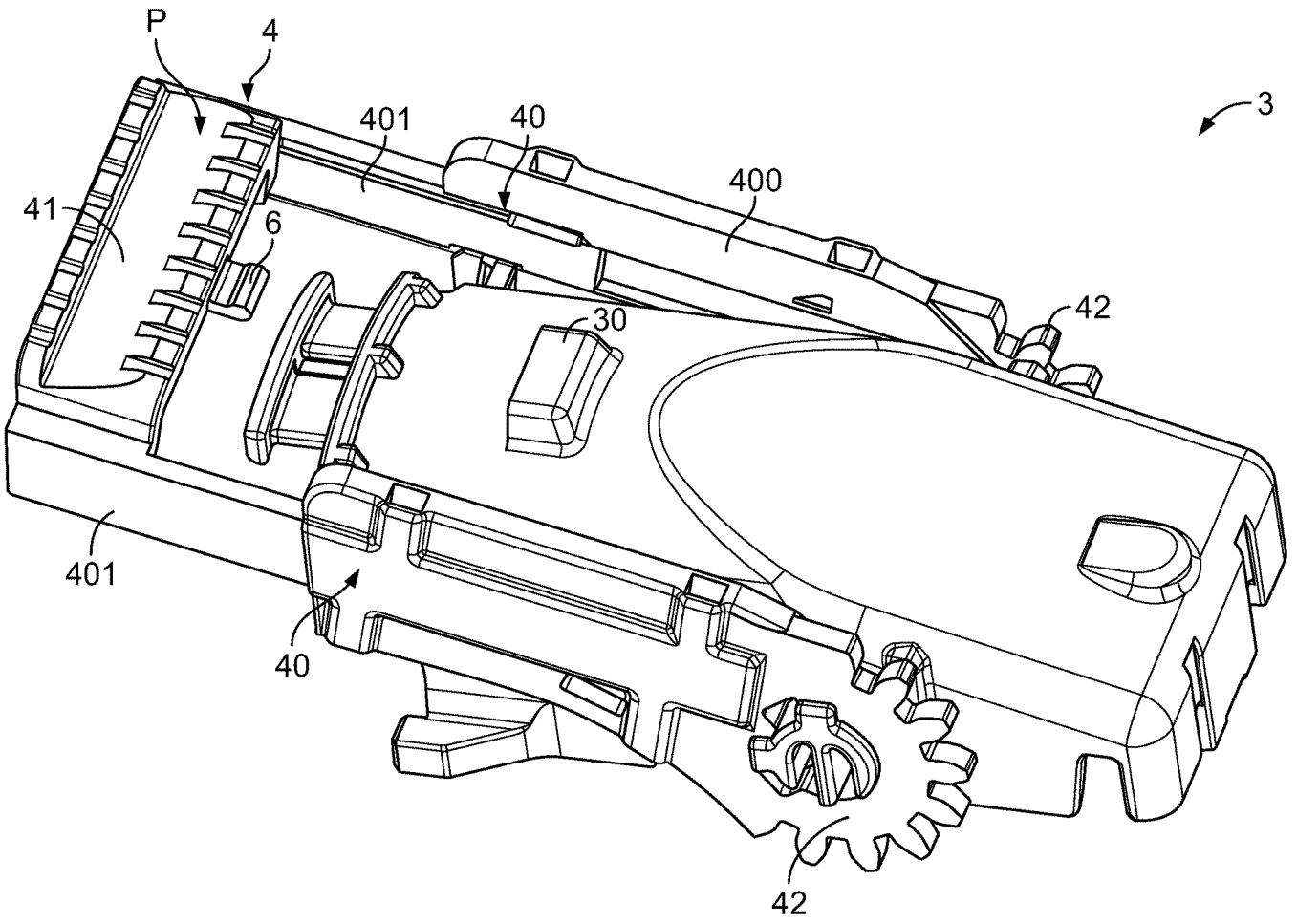
FIG. 7 is a perspective view of the electrical connector of FIG. 4 in an operative position with a lever of the electrical connector in an elongated lever position.

The lever 4 of the connector E is rotatable from a first, inoperative position shown in FIG. 6 to an operative position shown in FIG. 7. The mode of operation of the connector E is the same as that of the connector C. The rotation of the lever 4 from the inoperative position to the operative position causes, by way of the engagement of the toothed wheels 42 with the rack 5, the advancement of the slide member 2 within the contact-carrying body 1. This movement of the slide member 2 causes the lowering of the contact-carrying body 1 above the mating connector O by way of the engagement of the pins O1 in the slits 20 of the slide member 2.

Figure 8:
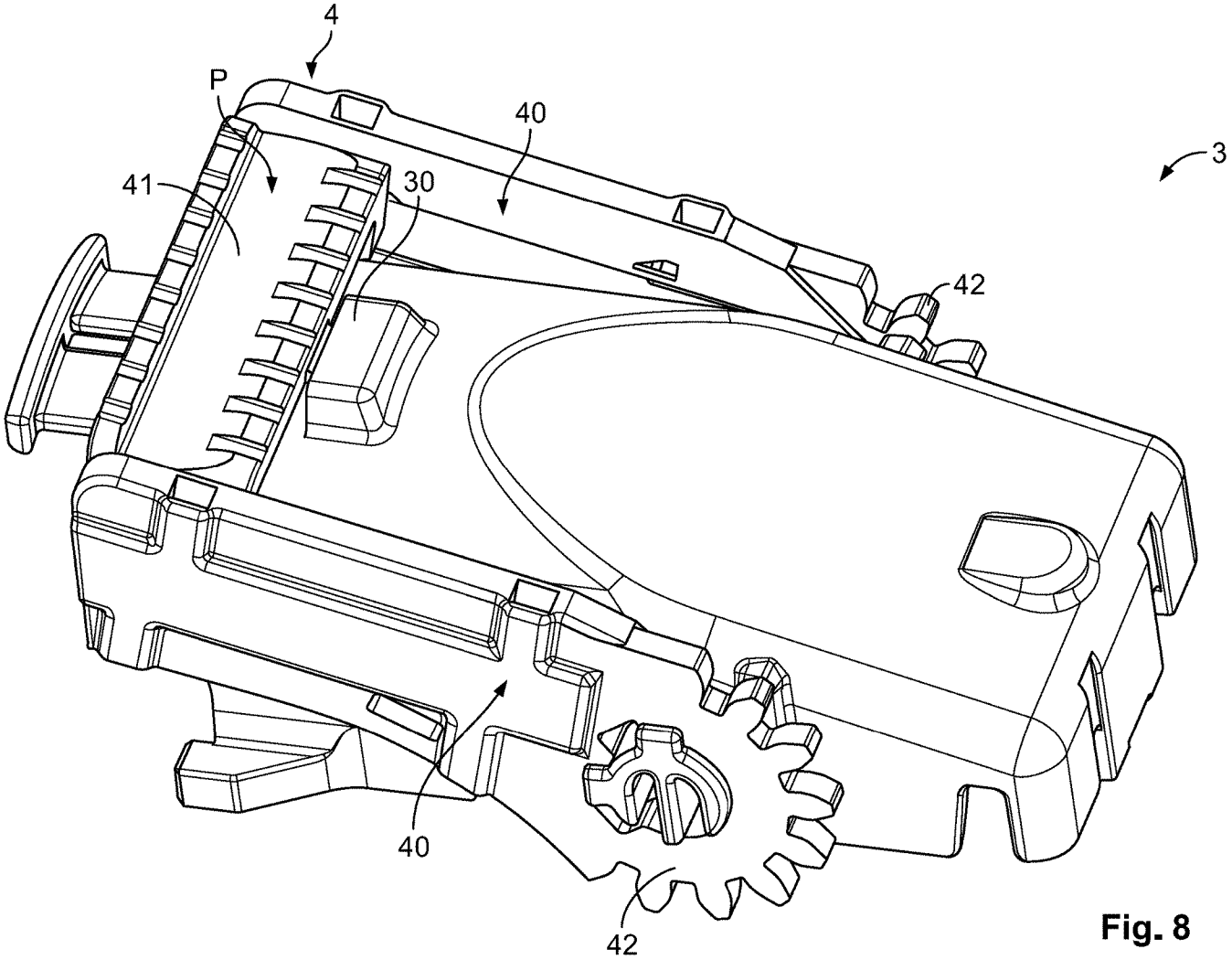
FIG. 8 is a perspective view of the electrical connector of FIG. 4 in the operative position with the lever in a shortened lever position.
Figure 9:
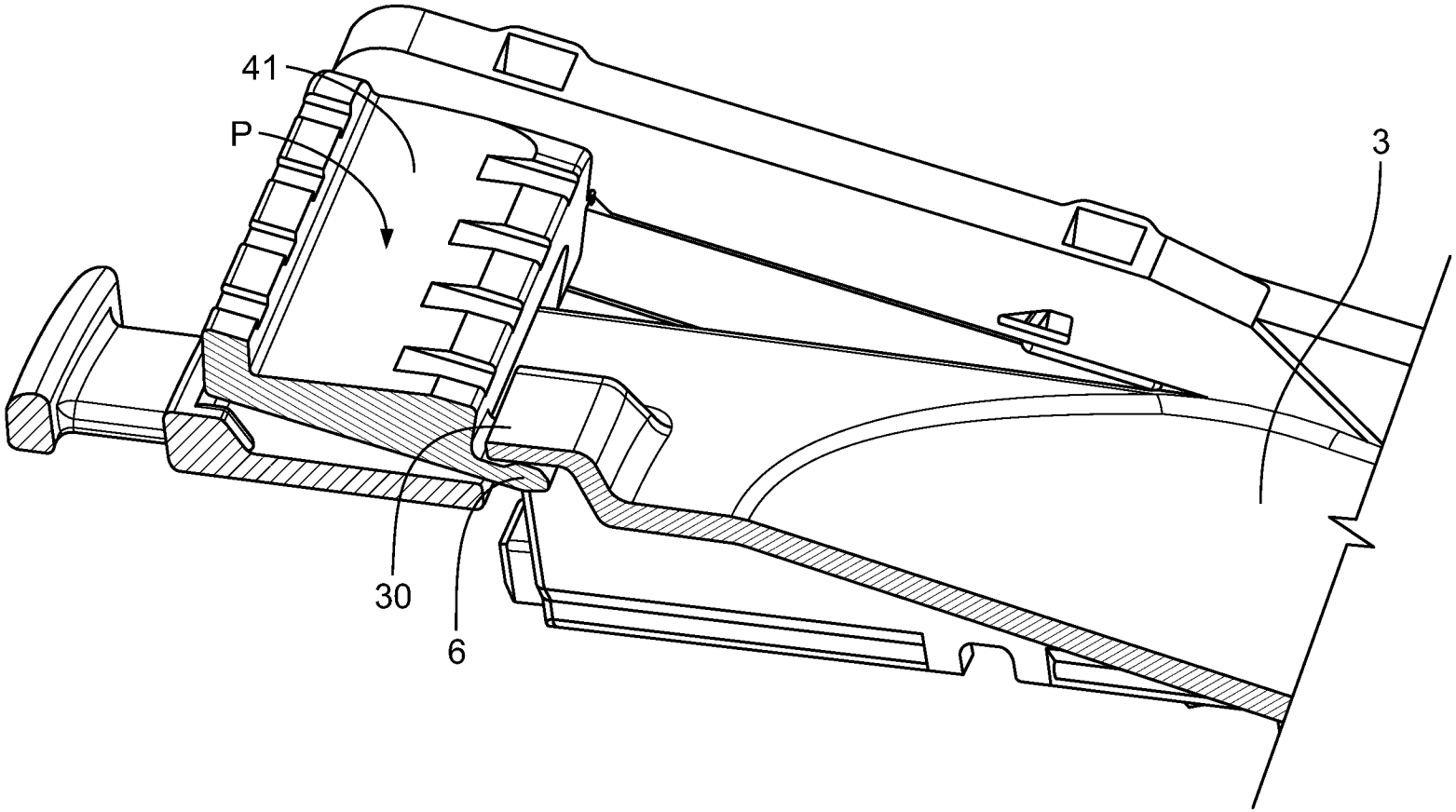
FIG. 9 is a sectional perspective view of the lever in the shortened lever position.

As a result of the telescopic structure of the lever 4 in the connector E, the movable portion P of the lever is movable between an elongated lever position shown in FIG. 7 and a shortened lever position shown in FIG. 8. The telescopic structure of the lever 4 makes it possible to modify the arm of the lever 4. As a result, the connector E is particularly simple and easy to use, as a force required to rotate the lever 4 from its inoperative position to its operative position is significantly reduced in the elongated state of the lever 4. Due to the telescopic structure, a user can actuate the lever 4 without difficulty and without requiring an increase in the volume of the connector E in a state in which it is mated with the mating connector O, as the lever 4 can be moved into the shortened lever position after being rotated to the operative position.

Figure 10:
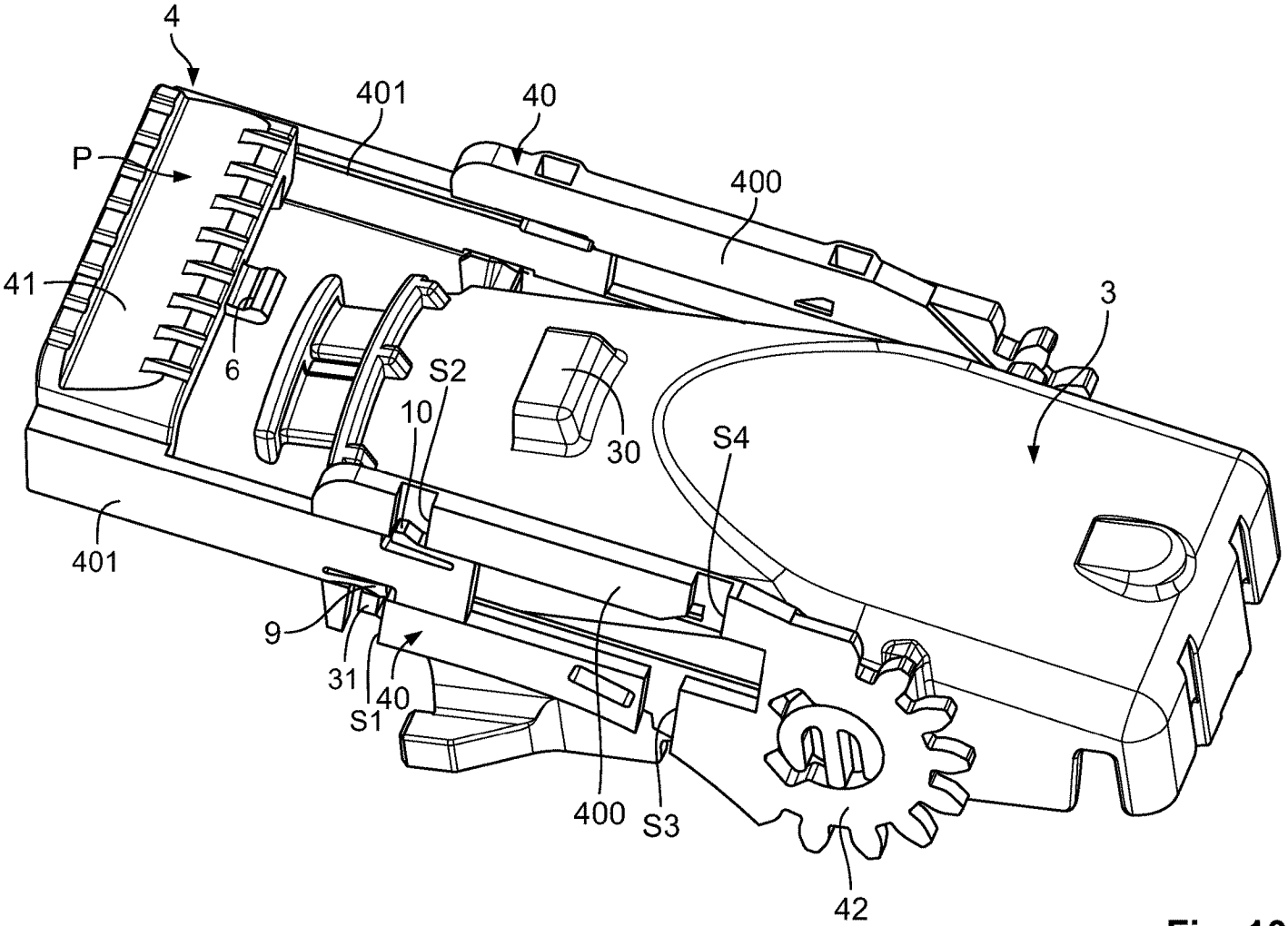
FIG. 10 is a sectional perspective view of the electrical connector of FIG. 4 in the operative position with the lever the elongated lever position.
Figure 11:
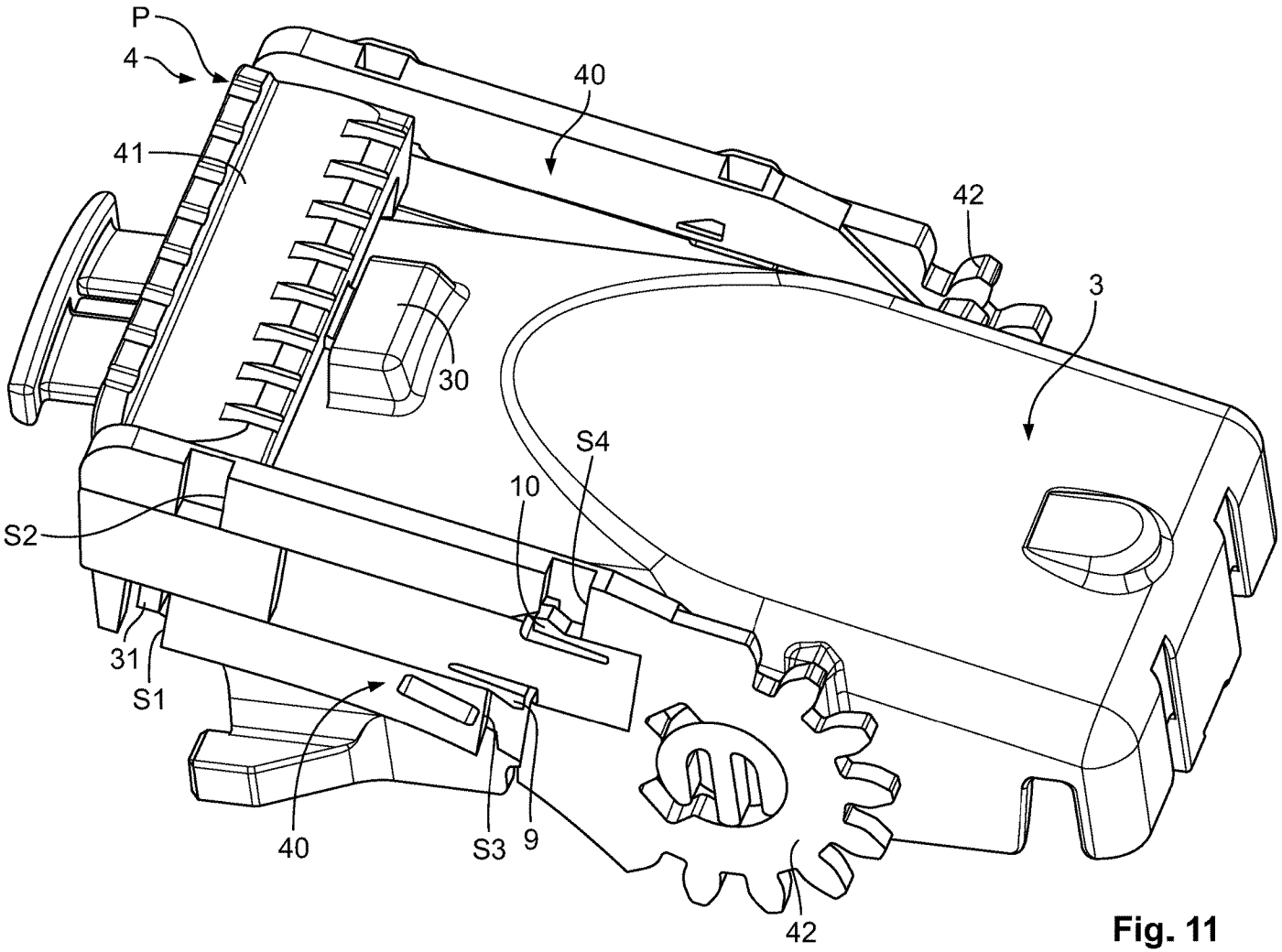
FIG. 11 is a sectional perspective view of the electrical connector of FIG. 4 in the operative position with the lever in the shortened lever position.

As shown in FIGS. 10 and 11, each second arm portion 401 is slidably mounted in a respective groove 8 extending along the first arm portion 40. In other embodiments, the second arm portion 401 may be slidably mounted with respect to the first arm portion 400 in any other configuration permitting the sliding of the second arm portion 401 described herein.

Each second arm portion 401 has a first elastic tooth 9 which, in the elongated lever position shown in FIG. 10, engages in a first seat S1 provided on the first arm portion 400. The engagement of the teeth 9 and the seats S1 prevents shortening of the lever 4 until the lever 4 is rotated from its inoperative position to its operative position. When the lever 4 is in its operative position, the elastic teeth 9 cooperate with two engagement elements 31 disposed on the upper body 3 of the connector C. The engagement elements 31, as shown in FIGS. 5, 10, and 11, are disposed close to the movable portion of the lever 4 at a side face of the upper body 3. In the operative position of the lever 4, the two engagement elements 31 disengage the first elastic teeth 9 from the seats S1 and movement of the movable part P of the lever 4 into the shortened lever position is enabled.

Each second arm portion 401 has a second elastic tooth 10 which, in the elongated lever position shown in FIG. 10, engages in a second seat S2 provided on the first arm portion 400. The teeth 10 and the seats S2 are shaped to prevent removal of the movable part P of the lever 4 from the first arm portions 400 in a direction opposite to the movement of the movable part P from the elongated lever position to the shortened lever position.

When the lever 4 is in the shortened lever position shown in FIG. 11, the first elastic tooth 9 and the second elastic tooth 10 engage in respective end seats S3, S4 provided on each first arm portion 400 of the lever 4. The end seat S4 engages the second elastic tooth 10 to prevent elongation of the lever 4. To bring the lever 4 back into the elongated lever position, it is necessary to pull the lever 4 using at least a minimum load sufficient to release the teeth 9, 10 from the seats S3, S4; the seats S3, S4 have internal chamfers and/or stop faces suitably inclined to promote the release of the teeth 9, 10 from the seats S3, S4.

The electrical connector E has a safety locking member performing a connection position assurance ("CPA") function. In the embodiment shown in FIGS. 7-9, the safety locking member includes a locking tooth 6 disposed on the handle 41 of the lever 4. When the lever 4 is rotated into the operative state thereof, the engagement elements 31 free the teeth 9 from the seats S1 in such a way that the movable portion P can be moved into the shortened lever position shown in FIGS. 8 and 9, and the locking tooth 6 engages with a pocket 30 disposed on the upper face of the upper body 3. The engagement of the locking tooth 6 with the pocket 30, also referred to as a safety locking position, prevents the lever 4 from moving away from the operative position. Conversely, when the lever 4 is not in the operative position corresponding to complete coupling of the connector E to the mating connector O, it is not possible to move the movable part P so as to shorten the lever 4 and thus to lock the tooth 6 to the pocket 30, since the engagement elements 31 do not free the teeth 9 from the seats S1.

Locking of the locking tooth 6 to the pocket 30 thus provides assurance that the electrical connector E is fully mated to the mating connector O; the locking tooth 6 can only lock to the pocket 30 to prevent the lever 4 from moving away from its operative position if the lever 4 is rotated far enough to reach the correct operative position completing coupling of the connector E and the mating connector O.

What is claimed is:

1. An electrical connector, comprising:

a contact-carrying body having a plurality of electrical terminals;

a slide member slidably mounted within the contact-carrying body and having a rack;

an upper body mounted to the contact-carrying body; and a lever pivotally mounted on the upper body and having a toothed wheel engaging the rack such that movement of the lever between an inoperative position and an operative position moves the slide member between a retracted position and an advanced position, the lever having a pair of arms and a handle connecting the pair of arms, each arm of the lever has a telescoping structure including a first arm portion and a second arm portion slidably mounted with respect to the first arm portion and connected to the handle, a movable portion of the lever including the second arm portion of each arm and the handle is movable with respect to each of the first arm portions between an elongated lever position and a shortened lever position, the movable portion of the lever has a safety locking member movable to a safety locking position and engaging the upper body only when the lever is in the operative position and the movable portion is in the shortened lever position.

2. The electrical connector of claim 1, wherein the safety locking member prevents the lever from moving away from the operative position when the safety locking member is in the safety locking position.

3. The electrical connector of claim 2, wherein the safety locking member includes a locking tooth disposed on the handle.

4. The electrical connector of claim 3, wherein the locking tooth engages a pocket disposed on the upper body in the safety locking position when the lever is in the operative position and the movable portion is in the shortened lever position.

5. The electrical connector of claim 4, wherein each second arm portion is slidably mounted in a groove extending along the first arm portion.

6. The electrical connector of claim 5, wherein each second arm portion has a first elastic tooth engaging a first seat of the first arm portion in the elongated lever position and preventing movement of the lever to the shortened lever position when the lever is not in the operative position.

7. The electrical connector of claim 6, wherein each second arm portion has a second elastic tooth engaging a second seat of the first arm portion in the elongated lever position and preventing removal of the movable part from the first arm portions.

8. The electrical connector of claim 7, wherein the upper body has a pair of engagement elements each contacting one of the first elastic teeth in the operative position of the lever and disengaging the first elastic teeth from the first seats.

9. The electrical connector of claim 8, wherein the movable portion is movable from the elongated lever position to the shortened lever position only after engagement elements disengage the first elastic teeth from the first seats.

10. The electrical connector of claim 9, wherein, when the lever is in the shortened lever position, the first elastic teeth and the second elastic teeth each engage in one of a plurality of end seats disposed on the first arm portions.

11. An electrical connector, comprising:

a contact-carrying body having a plurality of electrical terminals;

a slide member slidably mounted within the contact-carrying body and having a rack;

an upper body mounted to the contact-carrying body; and a lever pivotally mounted on the upper body and having a toothed wheel engaging the rack such that movement of the lever between an inoperative position and an operative position moves the slide member between a retracted position and an advanced position, the lever having a pair of arms and a handle connecting the pair of arms, each arm of the lever has a telescoping structure including a first arm portion and a second arm portion slidably mounted with respect to the first arm portion and connected to the handle, a movable portion of the lever including the second arm portion of each arm and the handle is movable with respect to each of the first arm portions between an elongated lever position and a shortened lever position, each second arm portion is slidably mounted in a groove extending along the first arm portion, each second arm portion has a first elastic tooth engaging a first seat of the first arm portion in the elongated lever position and preventing movement of the lever to the shortened lever position when the lever is not in the operative position.

12. The electrical connector of claim 11, wherein each second arm portion has a second elastic tooth engaging a second seat of the first arm portion in the elongated lever position and preventing removal of the movable part from the first arm portions.

13. The electrical connector of claim 12, wherein the upper body has a pair of engagement elements each contacting one of the first elastic teeth in the operative position of the lever and disengaging the first elastic teeth from the first seats.

14. The electrical connector of claim 13, wherein the movable portion is movable from the elongated lever position to the shortened lever position only after engagement elements disengage the first elastic teeth from the first seats.

15. The electrical connector of claim 14, wherein, when the lever is in the shortened lever position, the first elastic teeth and the second elastic teeth each engage in one of a plurality of end seats disposed on the first arm portions.

* * * * *